United States Patent [19]

Gruber et al.

[11] Patent Number: 4,578,338

[45] Date of Patent: Mar. 25, 1986

[54] DEVELOPMENT PROCESS WITH TONER COMPOSITION CONTAINING LOW MOLECULAR WEIGHT WAXES

[75] Inventors: Robert J. Gruber, Pittsford; Ronald J. Koch, Webster; John F. Knapp, Fairport, all of N.Y.

[73] Assignee: Xerox Corporation, Stamford, Conn.

[21] Appl. No.: 645,892

[22] Filed: Aug. 31, 1984

[51] Int. Cl.[4] ..... G03G 13/14

[52] U.S. Cl. ..... 430/120; 430/124; 430/126

[58] Field of Search ..... 430/99, 124, 120, 126; 355/3 FU, 14 FU; 118/260

[56] References Cited

U.S. PATENT DOCUMENTS

| | | | |
|---|---|---|---|
| 3,993,483 | 11/1983 | Maki et al. | 96/1 LY |
| 4,287,280 | 9/1981 | Swift | 430/124 |
| 4,309,957 | 1/1982 | Swift | 118/260 |
| 4,367,275 | 1/1983 | Aoki et al. | 430/99 |
| 4,409,312 | 10/1983 | Ikeda et al. | 430/110 |
| 4,460,672 | 7/1984 | Gruber et al. | 430/110 |

FOREIGN PATENT DOCUMENTS

| | | |
|---|---|---|
| 0059109 | 9/1982 | European Pat. Off. . |
| 0066470 | 12/1982 | European Pat. Off. . |
| 57-22248 | 2/1982 | Japan . |
| 57-84460 | 5/1982 | Japan . |
| 57-89767 | 6/1982 | Japan . |
| 57-168253 | 10/1982 | Japan . |
| 1442835 | 7/1976 | United Kingdom . |

*Primary Examiner*—John L. Goodrow
*Attorney, Agent, or Firm*—E. O. Palazzo

[57] ABSTRACT

An improved process for the development and fixing of electrostatic latent images which comprises (1) generating an electrostatic latent image on a photoconductive imaging member, (2) developing this image with a toner composition comprised of toner resin particles, pigment particles, and a wax component of a molecular weight of from about 500 to about 20,000, (3) transferring the developed image to a suitable substrate, and subsequently (4) fusing the transferred image with a compliant oil fuser roll, wherein the amount of fuser oil consumed is from about one microliter to about three microliters per page of developed image.

26 Claims, No Drawings

DEVELOPMENT PROCESS WITH TONER COMPOSITION CONTAINING LOW MOLECULAR WEIGHT WAXES

BACKGROUND OF THE INVENTION

This invention is generally directed to processes for developing images; and more specifically the present invention is directed to an improved process for developing electrostatic latent images with a toner composition containing therein various low molecular weight wax compositions. Thus, in one embodiment of the present invention there is provided a process for the fixing of images in electrostatic imaging systems with a compliant fuser roll, such as a Viton fuser roll, wherein a release fluid including silicone oils is selected for the purpose of improving the fusing latitude, and release characteristics of the toner composition selected, which toner composition is comprised of resin particles, and certain additive waxes. Accordingly, the toner and developer compositions of the present invention are useful for enabling the development of images in electrostatographic systems, particularly those imaging systems wherein a compliant fuser roll is selected and reduced amounts of silicone oils are utilized.

Generally, prior art developer compositions selected for use in developing electrostatic images enable the toner image to be fixed to a permanent substract, such as paper, by contacting the paper with a roller, the surface of which is formed from a material capable of preventing toner particles from sticking thereto. Usually in this process, however, the surface of the fixing roll is brought into contact with the toner image in a hot melt state, thus a part thereof can adhere to and remain on the surface of this roll. This causes a portion of the toner image to be transferred to the surface of a subsequent sheet on which the toner image is to be successively fixed, thereby causing the well known undesirable offset phenomena.

For the purpose of substantially eliminating offsetting, and more specifically to prevent adhesion of the toner particles to the surface of the fixing means, there has been selected certain types of rollers, the surface of which may be covered with a thin film of an offset preventing liquid such as a silicone oil. These oils are highly effective, however, the apparatus within which they are incorporated is complicated and costly since, for example, a means for feeding the oil is required. Also, not only do the silicone oils emit an undesirable odor, they deposit on the machine components causing toner particles to collect on, and adhere to the silicone oils. An accumulation of toner particles on machine components is troublesome in that the image quality is adversely effected, and these components must be periodically cleaned and/or replaced, adding to the maintenance costs of the system involved.

One Viton fuser roll selected for use in electrostatographic copying machines is comprised of a soft roll fabricated from lead oxide, and duPont Viton E-430 resin, a vinylidene fluoride hexafluoropropylene copolymer. This roll contains approximately 15 parts of lead oxide, and 100 parts of Viton E-430, which mixture is blended and cured on the roll substrate at elevated temperatures. Apparently the function of the lead oxide is to generate unsaturation by dehydrofluorination for crosslinking, and to provide release mechanisms for the toner composition. Excellent image quality has been obtained with Viton fuser rolls, however, in some instances there results a toner fuser compatibility problem when charge control agents are part of the toner mixture. For example, it appears that certain specific charge control additives, such as quaternary ammonium compounds, and alkyl pyridinium compounds, including cetyl pyridinium chloride, react with the Viton of these fuser rolls. For example, cetyl pyridinium chloride when part of the toner mixture appears to be catalytically decomposed by the lead oxide contained in the fuser roll, resulting in a highly unsaturated compound, which polymerizes and condenses with the unsatured Viton E-430 material. In view of this, the Viton fuser roll turns black, develops multiple surface cracks, and the surface thereof hardens, thereby resulting in image quality deterioration.

Also, disclosed in a copending application, U.S. Ser. No. 434,198, entitled Positively Charged Toner Compositions, are toner compositions comprised of resin particles, pigment particles, a low molecular weight wax material, and a charge enhancing additive. These toner compositions are particularly useful in electrostatic imaging systems wherein an offset preventing fluid, such as a silicone oil, is not required. In contrast, in accordance with the present invention a reduced amount of offset preventing liquid is selected, and the fusing latitude temperature for the selected toner composition is desirably increased.

A substantial number of the electrostatographic imaging machines in commecial use incorporate therein various offset preventing liquids, such as silicone oils, and while these oils possess a number of disadvantages there have been developed compositions and processes wherein some of the disadvantages are eliminated. Therefore, the use of silicone oils in electrophotographic imaging systems continues to be viable, and thus processes which continue to use such oils are required. Additionally, there is a need for processes wherein the amount of silicone oil used an be reduced somewhat, and wherein the fusing latitude of the toner composition can be desirably increased. Furthermore, there continues to be a need for processes for developing images with a toner composition containing low molecular weight waxes and wherein there is selected a compliant fuser roll such as a Viton fuser roll. Also, there continues to be a need for imaging processes wherein soft compliant fuser rolls are selected, and the developer composition in addition to containing a low molecular weight wax has incorporated therein charge enhancing additives.

SUMMARY OF THE INVENTION

It is an object of the present invention to provide processes for the development of electrostatic latent images wherein the toner composition selected contains a low molecular weight wax.

In another object of the present invention there is provided processes for the development of electrostatic latent images wherein a compliant fuser roll is selected, and the amount of fuser oil used is substantially reduced.

In a further object of the present invention there is provided processes for the development of electrostatic latent images wherein fusing is affected with a compliant fuser roll, and the toner composition processes have improved fusing latitudes.

In yet another object of the present invention there is provided processes for the development of electrostatic latent images wherein the toner composition has incorporated therein a low molecular weight wax, such as polypropylene, or polyethylene, and wherein a significantly reduced amount of fuser oil is selected for the compliant Viton fuser roll system.

In another object of the present invention there is provided processes for the development of negatively charged electrostatic latent images, wherein the toner composition has incorporated therein a low molecular weight polypropylene or polyethylene, wax, and a charge enhancing additive, and further wherein the amount of fuser oil selected is significantly reduced. Further, in an additional object of the present invention there are provided processes for the development of electrostatic latent images wherein the minimum fix temperature selected for fusing of the final image is reduced enabling a desirable reduction in power consumption, and improved life of the fusing components thus allowing extended usage of the fuser system.

In a further object of the present invention there are provided processes for the development of electrostatic latent images wherein reduced amounts of silicone oil are selected without adversely effecting image quality.

An additional object of the present invention resides in a process for developing images wherein copy quality is desirably improved in that the amount of oil on substrates with developed images thereon is reduced, and machine contamination is decreased since less oil is selected for the development process.

These and other objects of the present invention are accomplished by providing improved processes for causing the development of electrostatic latent images wherein significantly reduced amounts of fuser oils are selected. More specifically, in one aspect the present invention is directed to an improved process for causing the development and fusing of electrostatic latent images which comprises (1) generating an electrostatic latent image on a photoconductive imaging member, (2) developing this image with a toner composition containing therein a low molecular weight wax, (3) transferring the developed image to a suitable substrate, and (4) fusing the image with a compliant fuser roll, wherein the amount of fuser oil selected is from about one microliter per page to about four microliters per page, and preferably from about two microliters per page to about three microliters per page, as compared to the use of from about six microliters per page to about nine microliters per page with prior art systems. Moreover, in accordance with the process of the present invention the fusing latitude range is desirably increased from about 10° C. to about 30° C.

Illustrative examples of resins useful for toner compositions of the present invention include numerous known suitable polymers such as polyesters, styrene/-methacrylates, polyamides, epoxies, polyurethanes, vinyl resins, and polymeric esterification products of a dicarboxylic acid and a diol comprising a diphenol. Suitable viny resins include homopolymers or copolymers of two or more vinyl monomers. Typical examples of vinyl monomeric units include: styrene, p-chlorostyrene, ethylenically unsaturated mono-olefins such as ethylene, propylene, butylene, isobutylene and the like; diolefins; vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; diolefins including styrene butadiene resins, especially those containing a high percentage of styrene, as disclosed in copending application U.S. Ser. No. 453,253, filed Dec. 27, 1982, and entitled Styrene Butadiene Plasticizer Toner Composition Blends, the disclosure of which being totally incorporated herein by reference, and mixtures thereof.

The preferred toner resins are selected from polystyrene methacrylate resins, styrene butadiene resins, polyester resins such as those described in U.S. Pat. No. 3,655,374, the disclosure of which is totally incorporated herein by reference, polyester resins resulting from the condensation of dimethylterephthalate, 1,3 butanediol, and pentaethythriol, and Pliolite resins. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene, and contains a plasticizer therein, reference the copending application U.S. Ser. No. 453,253.

The toner resin is present in an amount to provide a toner composition which will result in a total of about 100 percent for all components. Accordingly, for non-magnetic toner compositions the toner resin is generally present in an amount of from about 60 percent by weight to about 90 percent by weight, and preferably in an amount of from about 80 percent by weight to about 85 percent by weight. In one preferred embodiment, the toner composition is comprised of about 90 percent by weight of resin particles, 5 percent by weight of carbon black pigment particles, and 5 percent by weight of a low molecular weight wax.

Various known suitable colorants and/or pigment particles may be incorporated into the toner composition including, for example, carbon black, Nigrosine dye, magnetic particles such as Mapico Black, a mixture of iron oxides, and the like. The pigment particles are present in sufficient quantities enabling a highly colored toner composition thus allowing the formation of visible images on a recording member. Thus, for example, the pigment particles, with the exception of magnetic materials, could be present in the toner composition in an amount of from about 2 percent by weight to about 10 percent by weight. With regard to magnetic pigments such as Mapico Black, they are generally incorporated into the toner composition in an amount of from about 10 percent by weight to about 70 percent by weight, and preferably from about 20 percent by weight to about 50 percent by weight.

While the magnetic particles can be present in the toner composition as the only pigment, these particles may be admixed with other pigments such as carbon black. Thus, for example, in this embodiment of the present invention, there is present in an amount of from about 5 percent by weight to about 10 percent by weight, carbon black, and from about 10 to about 60 percent by weight of magnetic pigment. Other percentage combinations may be selected provided the objectives of the present invention are achieved.

The waxy material incorporated into the toner composition generally has a molecular weight of between about 500 and about 20,000, and preferably is of a molecular weight of from about 1,000 to about 5,000. Illustrative examples of low molecular weight waxy materials included within the scope of the present invention are polyethylenes, commercially available from Allied Chemical and Petrolite Corporation, Epolene N-15, commercially available from Eastman Chemical Products Inc., Viscol 550-P, a low molecular weight polypropylene available from Sanyo Kasei K.K. and similar materials. The commercially available polyethylenes selected have a molecular weight of about 1,000 to about 1,500, while the commercially available polypropylenes incorporated into the toner compositions of the present invention have a molecular weight of from about 4,000 to about 6,000. Many of the polyethylene and polypropylene compositions useful in the present invention are illustrated in British Pat. No. 1,442,835.

The wax component can be incorporated into the toner composition in various suitable amounts generally, however, these waxes are present in an amount of from about 2 percent by weight to about 20 percent by weight, and preferably in an amount of from about 5 percent by weight to about 10 percent by weight.

Illustrative examples of carrier components selected for a developer composition include those materials that are capable of triboelectrically obtaining a charge of opposite polarity to that of the toner particles including, such as, glass, steel, nickel, iron ferrites, silicone dioxide, and the like. These carriers can be used with or without a coating, which coatings can be comprised of fluoropolymers, including polyvinylidene fluoride commercially available from E. I. duPont Company. Additionally, there can be selected nodular carrier beads of nickel characterized by surfaces of reoccurring recesses and protrusions, thus providing particles with a relatively large external area, reference U.S. Pat. Nos. 3,847,604 and 3,767,598. The diameter of the coated carrier particles is from about 50 microns to about 1,000 microns, enabling the carrier particles to possess sufficient density and inertia to avoid adherence to the electrostatic images during the development process.

The carrier component is mixed with the toner composition in various suitable combinations, however, best results are obtained with from about 1 part by weight of toner particles to about 3 parts by weight of toner particles, to about 100 parts to 200 parts by weight of carrier particles.

In a further aspect of the present invention the developer compositions selected may include therein as optional components charge enhancing additives, for imparting a positive charge to the toner resin particles. These additives, which are incorporated into the toner composition in an amount of from about 0.5 percent by weight to about 20 percent by weight, can be blended into the developer mixture, or coated onto the pigment particles. Various known effective charge enhancing additives can be used including organic sulfonate and sulfate compositions, such as stearyl benzyl ammonium para-toluene sulfonate, stearyl dimethyl phenethyl ammonium methyl sulfonate, stearyl dimethyl phenethyl ammonium para-toluene sulfonate, cetyl diethyl benzyl ammonium methyl sulfate, myristyl dimethyl phenethyl ammonium para-toluene sulfonate, cetyl diethyl benzyl ammonium methylsulfate, and the like, reference for example U.S. Pat. No. 4,338,390, the disclosure of which is totally incorporated herein by reference; alkyl pyridinium halides; and quaternary ammonium salts. The preferred charge enhancing additives incorporated into the toner compositions of the present invention include cetyl pyridium chloride, and stearyl dimethyl penethyl ammonium para-toluene sulfonate.

Many known methods may be used for preparing the toner compositions of the present invention, inclusive of melt blending the resin particles, the pigment particles, the charge enhancing additive, and the low molecular weight wax, followed by mechanical attrition. Other methods include those well known in the art such as spray drying, melt dispersion, dispersion polymerization, and extrusion processing. For example, a solvent dispersion of resin particles, pigment particles, charge enhancing additive, and low molecular weight wax are spray dried under controlled conditions, thereby resulting in the desired toner composition. A toner prepared in this manner results in a positively charged toner composition in relation to the carrier materials, and these toners exhibit the improved properties as mentioned herein.

The toner and developer compositions of the present invention are very useful for developing electrostatic latent images, particularly those contained on an imaging member charged negatively. When employing the developing compositions of the present invention, it is not necessary to utilize substantial amounts of release fluid, such as a silicone oil to prevent toner offset, since the compositions of the present invention prevent toner offset with minimum amounts of toner release fluid. Additionally, as indicated hereinbefore, the toner compositions of the present invention can be charged positively, in view of the presence of the charge enhancing additive.

Examples of imaging surfaces that may be selected include various known photoreceptor compositions, particularly those which are negatively charged, which usually occurs with organic photoreceptors including layered photoreceptor materials. Illustrative examples of layered photoresponsive materials include those containing a substrate, a generating layer, and a transport layer, as disclosed in U.S. Pat. No. 4,265,990, the disclosure of which is totally incorporated herein by reference. Examples of generating layers include trigonal selenium, metal phthalocyanines, metal free phthalocyanines, and vanadyl phthalocyanine, while examples of transport materials include various diamines dispersed in resinous binders. Other organic photoresponsive materials that may be utilized in the practice of the present invention include polyvinyl carbzole, 4-dimethylaminobenzylidene, benzhydrazide; 2-benzylideneaminocarbazole, (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; and mixtures thereof. Also, the improved process of the present invention is useful for developing electrostatic latent images wherein there is selected imaging members comprised of selenium, selenium alloys, and halogen doped selenium alloys.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared by melt blending in a Banbury mixing device, maintained at 120° C., followed by mechanical attrition, a toner composition containing 86 percent by weight of a styrene butadiene resin (89/11, 89 percent by weight of styrene, and 11 percent by weight of butadiene), 6 percent by weight of carbon black particles, and 8 percent by weight of the low molecular weight wax polypropylene, commercially available from Sanyo Corporation as Viscol 550-P.

A developer composition was then prepared by mixing one part by weight of the above prepared toner composition, with 200 parts by weight of carrier particles consisting of a steel core coated with 1.25 of a copolymer of trifluoroethylene and vinyl chloride (FPC-461).

The above prepared developer composition was then incorporated into the Xerox Corporation 9200 copying apparatus with a Viton fuser roll, a silicone release fluid, about 3 liters, and wherein the photoreceptor was a selenium arsenic alloy. Latent electrostatic images were formed on the alloy photoreceptor, and subsequent to development the image was transferred to paper and fixing was effected with the Viton fuser roll. There resulted for 5,000 imaging cycles developed images of excellent resolution, and further only about 3 microliters of fuser oil were used for each page of developed image, as compared to from about 6 to about 9 microliters of fuser oil per page when a toner composition without the polypropylene wax was selected.

The fusing latitude for this toner composition was 60° F. as compared to a fusing temperature latitude of 30° F. for the same toner composition without the polypropylene wax.

Additionally, there resulted no offsetting of the toner images when there was selected for development the toner composition with the polypropylene wax. In contrast, significant offsetting of the images occurred when the same toner composition was selected without polypropylene wax. Moreover, there was an undesirable accumulation of toner particles on the fuser roll when the toner compositions without polypropylene wax were selected.

Moreover, excellent release characteristics resulted for the developer composition with the polypropylene wax in that substantially no toner was deposited on the 9200 fuser roll for over 35,000 copy cycles.

Other modifications of the present invention will occur to those skilled in the art based upon a reading of the present disclosure. These are intended to be included within the scope of this invention.

We claim:

1. An improved process for the development and fixing of electrostatic latent images consisting essentially of (1) generating an electrostatic latent image on a photoconductive imaging member, (2) developing this image with a toner composition comprised of toner resin particles, pigment particles, and a wax component of a molecular weight of from about 500 to about 20,000, (3) transferring the developed image to a suitable substrate, and subsequently (4) fusing the transferred image with a compliant oil fuser roll, wherein the amount of fuser oil consumed is from about one microliter to about three microliters per page of developed image.

2. An improved process in accordance with claim 1 wherein the fuser roll is a soft fuser roll.

3. An improved process in accordance with claim 1 wherein the amount of fuser oil used is three microliters per page.

4. An improved process in accordance with claim 1 wherein the toner resin particles are selected from the group consisting of styrenemethacrylate copolymers, styrene-acrylate copolymers, and styrene-butadiene copolymers.

5. An improved process in accordance with claim 4 wherein the styrene-methacrylate copolymer is styrene n-butylmethacrylate, and the styrene-butadiene copolymer is a thermoplastic resin with from about 75 to 95 percent by weight of styrene, and from about 5 percent to about 25 percent by weight of butadiene.

6. An improved process in accordance with claim 1 wherein the pigment particles are carbon black.

7. An improved process in accordance with claim 1 wherein the pigment particles are magnetites.

8. An improved process in accordance with claim 1 wherein the waxy material is polyethylene or polypropylene.

9. An improved process in accordance with claim 1 wherein the waxy material is polyethylene, or polypropylene present in an amount of from about 1 percent by weight to about 10 percent by weight.

10. An improved process in accordance with claim 1 wherein there is further included in the toner composition a charge enhancing additive.

11. An improved process in accordance with claim 1 wherein carrier particles are admixed with the toner composition.

12. An improved process in accordance with claim 10 wherein the charge enhancing additive is selected from the group consisting of alkyl pyridinium halides, organic sulfonate compositions, and organic sulfate compositions.

13. An improved process in accordance with claim 12 wherein the alkyl pyridinium compound is cetyl pyridinium chloride.

14. An improved process in accordance with claim 12 wherein the organic sulfate is stearyl dimethyl phenethyl ammonium para-toluene sulfonate.

15. An improved process in accordance with claim 1, wherein the molecular weight of the wax component is from about 1,000 to about 5,000.

16. An improved process in accordance with claim 1, wherein the wax component is present in an amount of from about 2 percent by weight to about 20 percent by weight.

17. An improved process in accordance with claim 10, wherein the charge enhancing additive is present in an amount of from about 0.5 percent by weight to about 20 percent by weight.

18. An improved process in accordance with claim 11, wherein the carrier particles include a coating thereover.

19. An improved process in accordance with claim 18, wherein the coating is selected from the group consisting of polyvinylidene fluorides, polymethylmethacrylates, and terpolymers of styrene, methacrylate and a vinyltrioxysilane, and a copolymer of trifluorochloroethylene and vinyl chloride.

20. An improved process for effecting the development and fixing of images in an electrostatic imaging apparatus with fuser oil present therein, consisting essentially of (1) generating an electrostatic latent image on a photoconductive imaging member; (2) developing this image with a toner composition comprised of toner resin particles, pigment particles, and a wax component of the molecular weight of from about 1,000 to about 5,000, and selected from the group consisting of polyethylene and polypropylenes; (3) transferring the developed image to a suitable substrate, and (4) subsequently fusing the transferred image with a compliant oil fuser roll, wherein the amount of fuser oil consumed is from about 1 microliter to about 3 microliters of fuser oil per page of developed image.

21. An improved process in accordance with claim 20, wherein a soft fuser roll is selected.

22. An improved process in accordance with claim 20, wherein the amount of fuser oil used is 3 microliters per page.

23. An improved process in accordance with claim 20, wherein the toner resin particles are selected from the group consisting of styrenemethacrylate copolymers, styrene-acrylate copolymers, and styrene-butadiene copolymers.

24. An improved process in accordance with claim 20, wherein the styrene-methacrylate copolymer is styrene n-butylmethacrylate, and the styrene-butadiene copolymer is a thermoplastic resin with from about 75 to 95 percent by weight of styrene, and from about 5 percent to about 25 percent by weight of butadiene.

25. An improved process in accordance with claim 20, wherein the pigment particles are carbon black.

26. An improved process in accordance with claim 20, wherein the pigment particles are magnetite.

* * * * *